US010938156B2

(12) United States Patent
Hanji et al.

(10) Patent No.: US 10,938,156 B2
(45) Date of Patent: Mar. 2, 2021

(54) SPLIT CONNECTOR

(71) Applicant: Sumitomo Wiring Systems, Ltd., Mie (JP)

(72) Inventors: Asuka Hanji, Mie (JP); Yukihiro Fukatsu, Mie (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/710,295

(22) Filed: Dec. 11, 2019

(65) Prior Publication Data

US 2020/0203887 A1 Jun. 25, 2020

(30) Foreign Application Priority Data

Dec. 21, 2018 (JP) ..... JP2018-239105

(51) Int. Cl.
*H01R 13/627* (2006.01)
*H01R 13/629* (2006.01)

(52) U.S. Cl.
CPC ..... *H01R 13/6273* (2013.01); *H01R 13/629* (2013.01)

(58) Field of Classification Search
CPC ..... H01R 13/6215; H01R 13/514–518; H01R 13/6273; H01R 13/629
USPC ..... 439/364, 701
See application file for complete search history.

(56) References Cited

U.S. PATENT DOCUMENTS 6,773,271 B2 * 8/2004 Falchetti ..... H01H 85/2045 439/701
7,485,012 B2 * 2/2009 Daugherty ..... H01R 13/514 439/540.1
7,682,183 B2 * 3/2010 Kanazawa ..... H01R 9/2408 439/357
8,043,127 B2 * 10/2011 Bailey ..... H01R 13/514 439/701
8,721,373 B2 * 5/2014 Suzuki ..... H01R 13/506 439/701
8,998,653 B2 * 4/2015 Kamiya ..... H01R 13/514 439/701
2004/0023564 A1 * 2/2004 Yamamoto ..... H01R 13/6272 439/701
2006/0154532 A1 * 7/2006 Yamada ..... B60R 16/0239 439/701

(Continued)

FOREIGN PATENT DOCUMENTS

JP 2002-313487 10/2002

*Primary Examiner* — Gary F Paumen
(74) *Attorney, Agent, or Firm* — Gerald E. Hespos; Michael J. Porco; Matthew T. Hespos

(57) ABSTRACT

A split connector has a frame (10) fittable to a mating connector (B). A mounting portion (13) penetrates the frame (10) in a connecting direction to the mating connector (B), and lock portions (15) are formed on two facing sides of opening edge parts of the mounting portion (13). A support (16) is disposed between the lock portions (15) in an opening area of the mounting portion (13). A sub-connector (25) is to be mounted into the mounting portion (13) while holding terminal fittings (13). Two first locks (27) are formed on the sub-connector (25) and hold the sub-connector (25) in the mounting portion (13) by being locked to the lock portions (15). A second lock (29) is formed on the sub-connector (25) and is lockable to the support (16) in a direction opposite to the connecting direction to the mating connector (B).

7 Claims, 8 Drawing Sheets

(56) References Cited

U.S. PATENT DOCUMENTS

| | | | | |
|---|---|---|---|---|
| 2012/0224932 | A1* | 9/2012 | Shibata | H01R 13/5202 411/105 |
| 2016/0156122 | A1* | 6/2016 | Bouda | H01R 13/506 439/518 |

* cited by examiner

SPLIT CONNECTOR

BACKGROUND

Field of the Invention

The invention relates to a split connector.

Related Art

Japanese Unexamined Patent Publication No. 2002-313487 discloses a male split connector provided with a frame, in which penetrating accommodating portions are open, and sub-connectors to be accommodated individually into the respective accommodating portions. Both left and right side walls of each accommodating portion are formed with lock pieces for holding the sub-connector in the accommodating portion.

When connecting the split connector to a mating connector, frictional resistance is created between terminal fittings of the split connector and mating terminals of the mating connector, and this frictional resistance becomes connection resistance that impedes a connecting operation of the sub-connectors. The connection resistance is supported in the frame by the lock pieces on both left and right end parts of the sub-connector. Thus, the sub-connector may be deformed improperly to be curved between the lock pieces.

The invention was completed on the basis of the above situation and aims to prevent improper deformation of a sub-connector.

SUMMARY

The invention is directed to a split connector with a frame that is finable to a mating connector. A mounting portion is formed in the frame and penetrates in a connecting direction to the mating connector. Two lock portions are formed on two facing sides at the opening edges of the mounting portion, and a support is disposed between the lock portions in an opening area of the mounting portion. A sub-connector is to be mounted into the mounting portion while holding a terminal fitting. Two first locks are formed on the sub-connector and hold the sub-connector in the mounting portion by being locked to the lock portions. Additionally, a second lock is formed on the sub-connector and is lockable to the support in a direction opposite to the connecting direction to the mating connector.

The mating connector generates connection resistance on the sub-connector when fitting the frame to the mating connector, and this connection resistance acts in a direction opposite to the connecting direction. Thus, the sub-connector may be deformed improperly to curve between the two lock portions. However, the support cooperates with the second lock to support an area of the sub-connector between the lock portions and prevents the sub-connector from being curved and deformed improperly.

The supporting portion of one embodiment couples the opening edge parts of the mounting portion and includes a supporting wall. A wall thickness direction of the supporting wall is oriented in a direction intersecting the connecting direction to the mating connector. According to this configuration, the supporting wall enhances the rigidity of the support so that the sub-connector can be supported reliably.

A receiving portion may be formed on the supporting wall and may be locked by the second lock. A reinforcing wall may be formed on the frame and connected to the supporting wall in an intersecting manner. According to this configuration, the reinforcing wall enhances the rigidity of the supporting wall and further prevents inclination or curving of the supporting wall in a wall thickness direction.

A rib may be formed on the supporting wall to extend along the connecting direction to the mating connector. The rib enhances the rigidity of the supporting wall and further prevents inclination or curving of the supporting wall in a wall thickness direction.

A receiving portion may project from the supporting wall and may be lockable by the second lock. Additionally, the receiving portion may be connected to the rib. According to this configuration, the rigidity of the receiving portion is enhanced by the rib so that the receiving portion and the second lock can be locked reliably.

DETAILED DESCRIPTION

Figure 5:
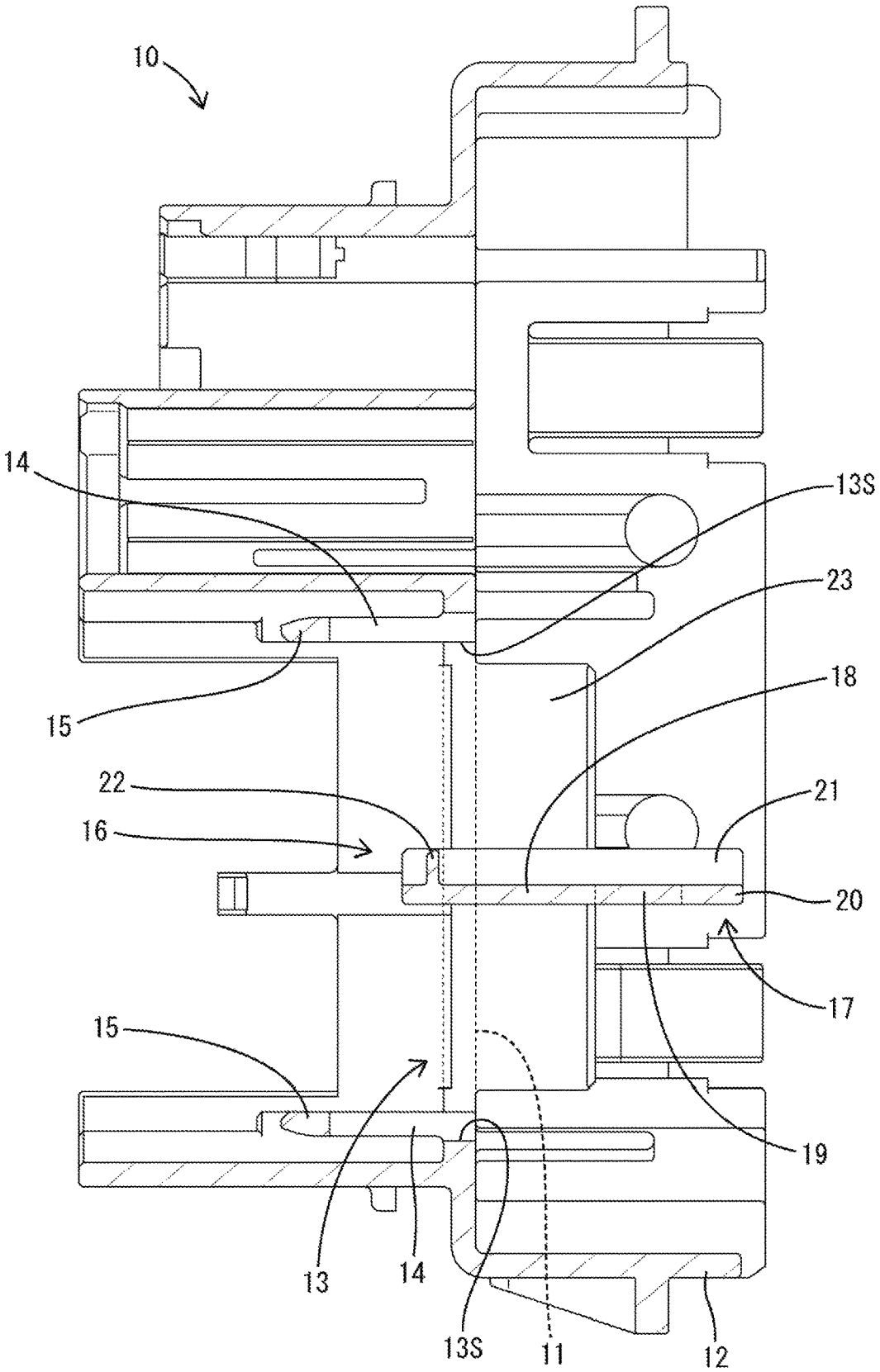
FIG. 5 is a section along Y-Y of FIG. 3.
Figure 6:
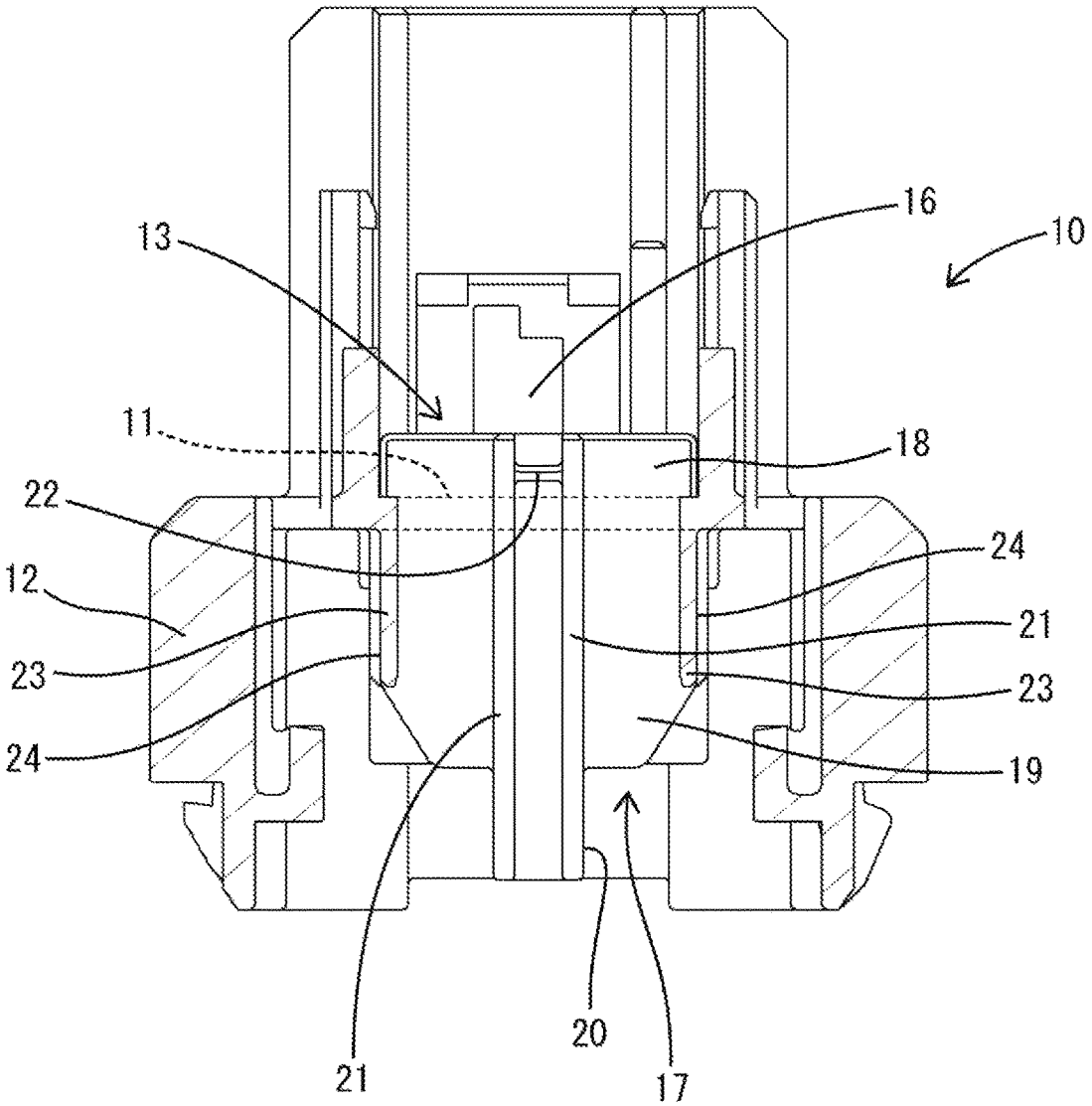
FIG. 6 is a section along Z-Z of FIG. 3.

An embodiment of the invention is described with reference to FIGS. 1 to 8. In the following description, a right side in FIGS. 2, 5 and 8 and a lower side in FIG. 6 are defined as a front concerning a front-rear direction. Upper and lower sides in FIGS. 1 to 5, 7 and 8 are defined as upper and lower sides concerning a vertical direction. Left and right sides in FIGS. 1, 3, 6 and 7 are defined as left and right sides concerning a lateral direction.

A split connector A of this embodiment is configured by assembling a frame 10 made of synthetic resin and sub-connectors 25. The frame 10 is a single member including a body 11 and a peripheral wall 12. The body 11 is a substantially flat plate with a plate thickness direction oriented in the front-rear direction (direction parallel to a connecting direction to a mating connector B). The peripheral wall portion 12 extends forward from the outer peripheral edge of the body 11. The frame 10 is formed with mounting portions 13 penetrating through the plate-like body 11 in the front-rear direction.

Figure 1:
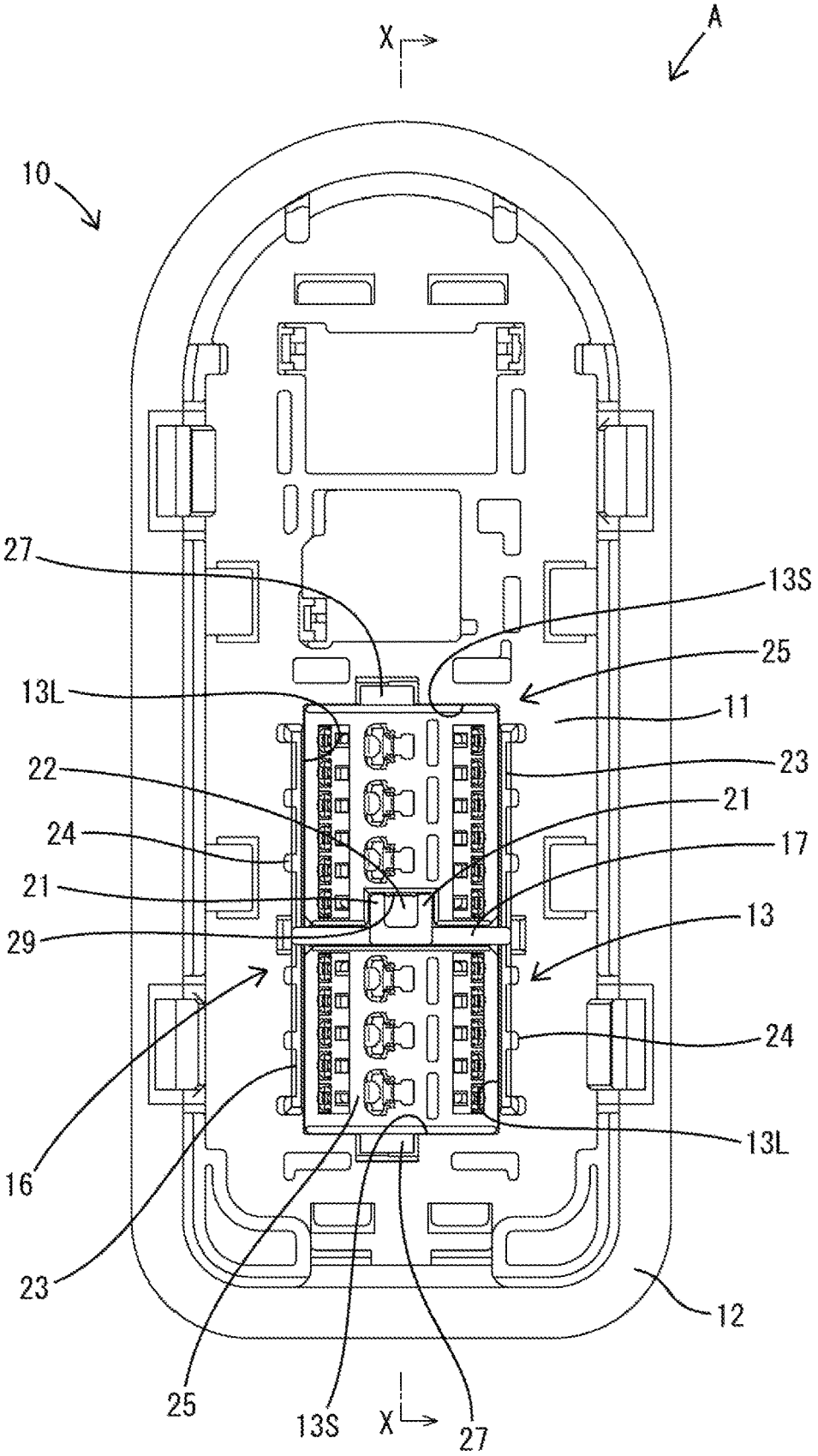
FIG. 1 is a front view of a male split connector of an embodiment.
Figure 2:
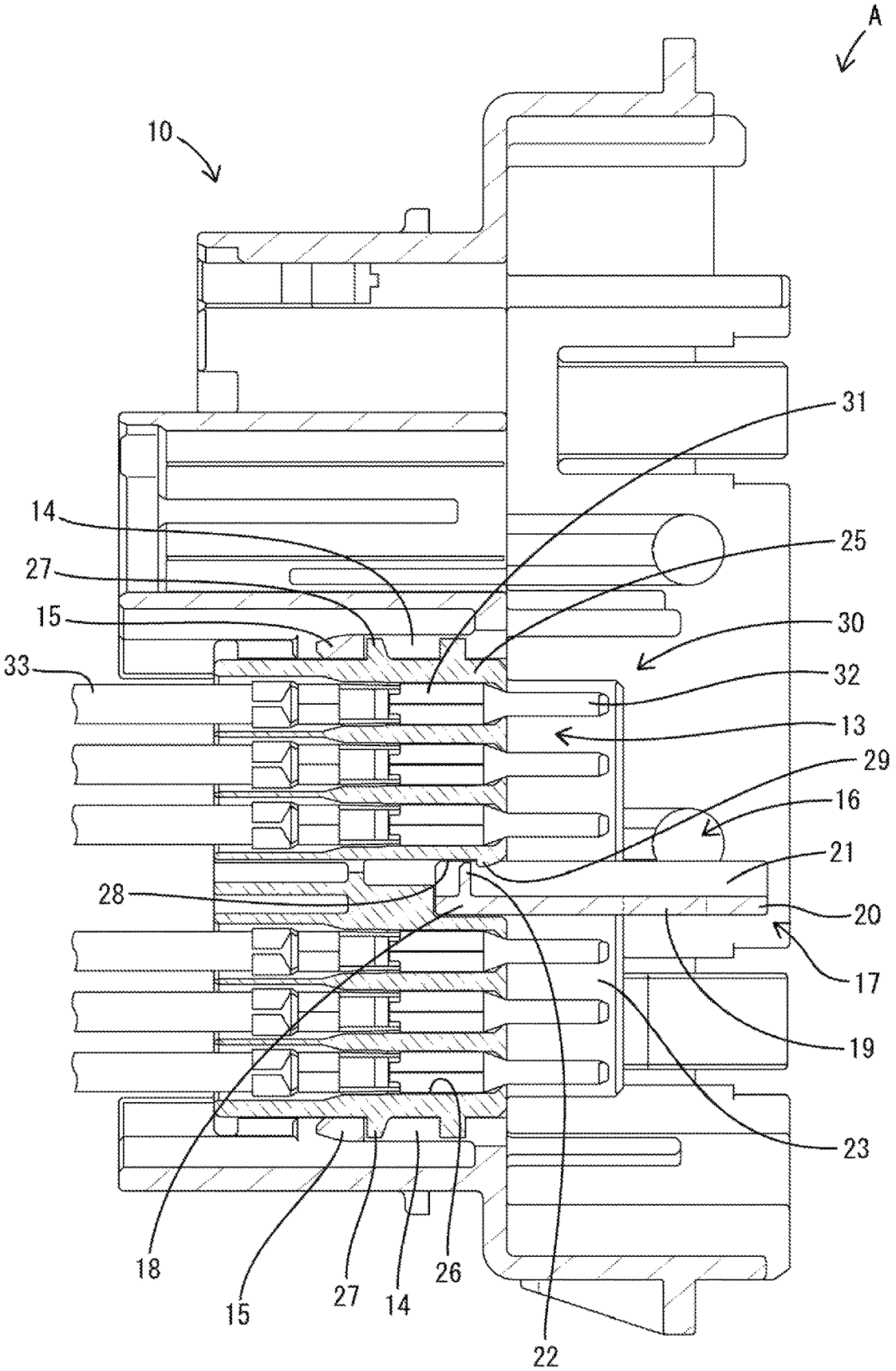
FIG. 2 is a section along X-X of FIG. 1.
Figure 3:
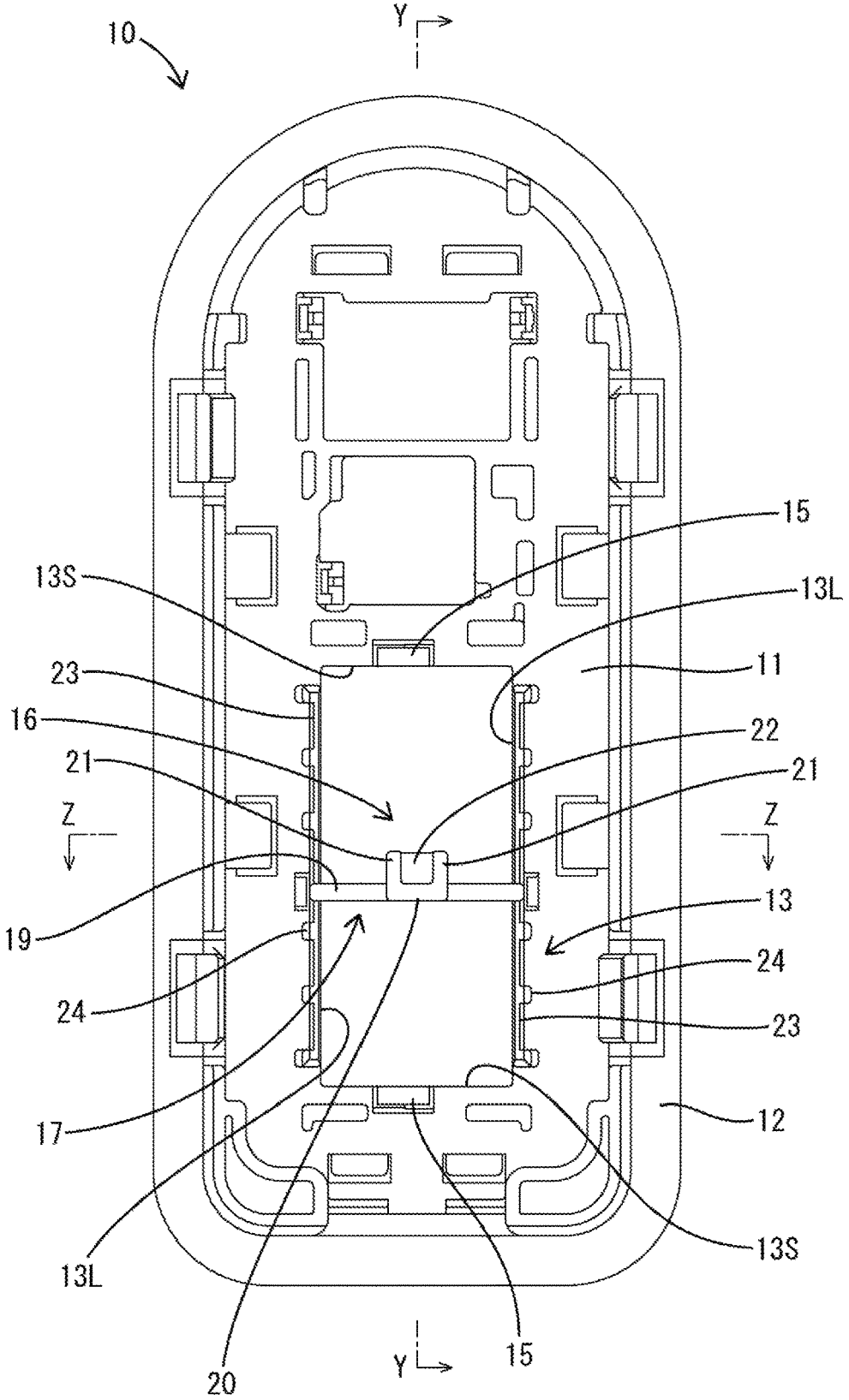
FIG. 3 is a front view of a male frame.
Figure 4:
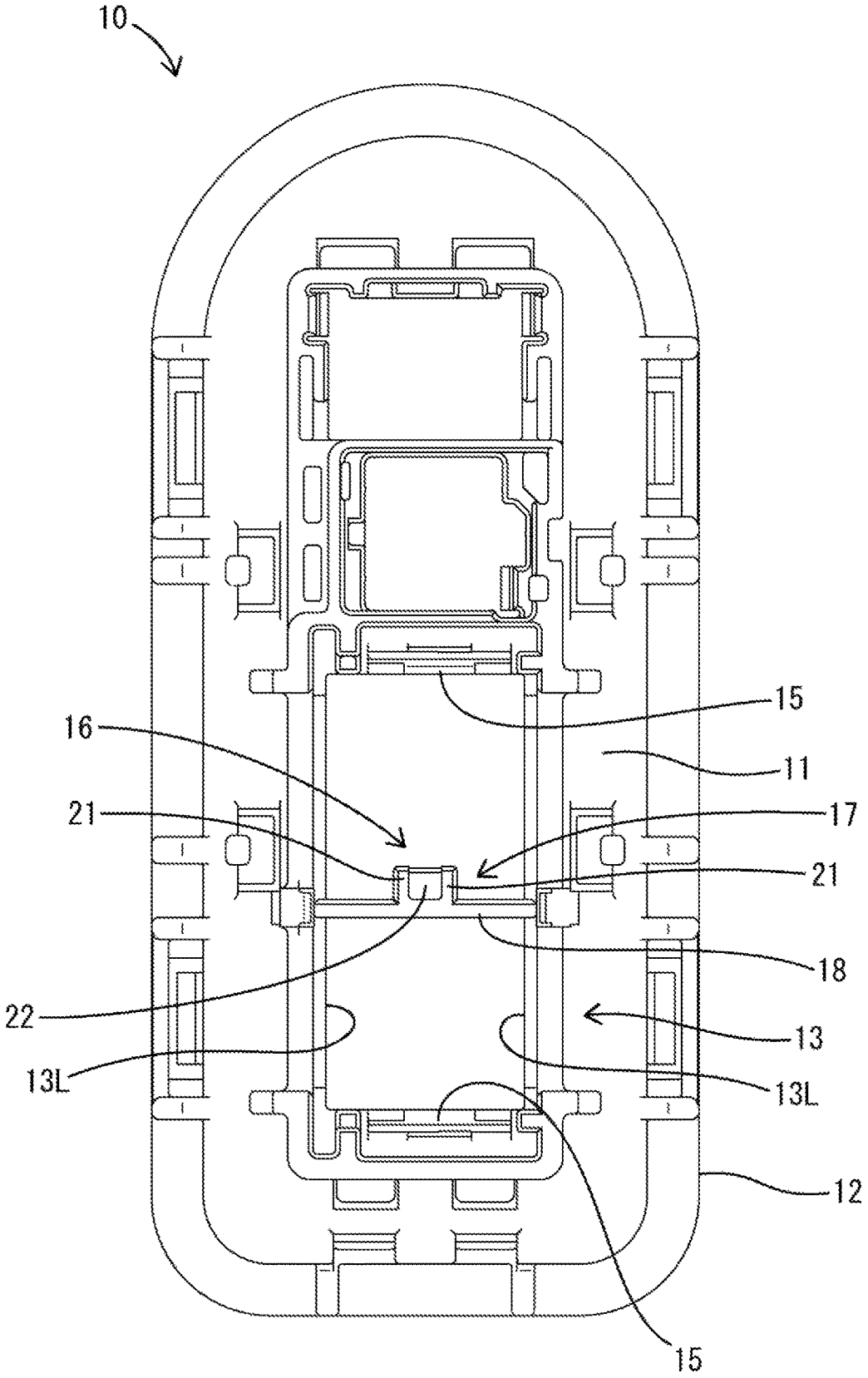
FIG. 4 is a back view of the male frame.

As shown in FIGS. 3 and 4, the front view shape (opening shape) of the mounting portion 13 located on the lowermost position is substantially rectangular with long sides L extending in the vertical direction and short sides 13S extending in the lateral direction. As shown in FIG. 5, two resilient lock pieces 14 are cantilevered rearward from edges of the upper and lower short sides 13S of the mounting portion 13. Each resilient lock piece 14 on the upper edge part is resiliently deformable upward, and the resilient lock piece 14 on the lower edge is resiliently deformable downward. Lock portions 15 are formed on rear end parts of the resilient lock pieces 14. The resilient lock pieces 14 (lock portions 15) hold the sub-connector 25 to be described later in a state mounted in the mounting portion 13.

As shown in FIGS. 2 to 6, the mounting portion 13 is formed with a support 16 for preventing the sub-connector 25 mounted in the mounting portion 13 from being resiliently deformed in an improper manner. The support 16 includes one supporting wall 17, left and right ribs 21 formed on the supporting wall 17, and a receiving portion 22 integrally formed to the supporting wall 17.

The supporting wall 17 horizontally bridges over an opening of the mounting portion 13 with a wall thickness direction thereof oriented vertically (direction perpendicular to the connecting direction of the split connector A and the mating connector B). Left and right end parts of the supporting wall 17 extending in the front-rear direction are connected to the vertical long sides 13L of the mounting portion 13. The supporting wall 17 is at a substantially middle position between the upper and lower lock portions 15 (pair of resilient lock pieces 14) in a front view parallel to the connecting direction to the mating connector B.

As shown in FIG. 6, the supporting wall 17 is composed of first, second and third walls 18, 19 and 20. The first wall 18 has a rectangular shape in a plan view. The second wall 19 has an isosceles trapezoidal shape in the plan view and extends forward from and is flush with the front edge of the first wall 18. The third wall 20 is cantilevered forward from a laterally central part of the front edge of the second wall 19. The third wall 20 is narrower than than the second wall 19. Both left and right edges of the second wall 19 are connected to the opening edges (plate-like body 11) of the mounting portion 13.

The two ribs 21 project up from the upper surface of the supporting wall 17. The ribs 21 extend straight in the front-rear direction in parallel to each other, and are formed continuously from the front end to the rear end of the supporting wall 17. Front parts of the ribs 21 are disposed along both left and right edges of the third wall 20. The ribs 21 extend rearward from the third wall 20 through laterally central parts of the second wall 19 and the first wall 18.

The ribs 21 enhance the rigidity of the supporting wall 17. In this way, the supporting wall 17 is restricted from resiliently deforming to be curved in a side view (direction perpendicular to the connecting direction of the split connector A and the mating connector B and perpendicular to the wall thickness direction of the supporting wall 17).

The receiving portion 22 is cantilevered up from a rear end part of the upper surface of the supporting wall 17 (first wall 18). A projecting direction of the receiving portion 22 is perpendicular to an assembling direction of the sub-connector 25 with the frame 10. The receiving portion 22 is sandwiched between the ribs 21, and both left and right edges of the receiving portion 22 are connected to the inner side surfaces of the ribs 21 facing each other. The receiving portion 22 is reinforced by the ribs 21 and restricted from being inclined and displaced in the front-rear direction (direction parallel to the mounting direction of the sub-connector 25 with the frame 10).

As shown in FIGS. 5 and 6, most (part of the first wall 18 and all of the second and third walls 19 and 20) of the supporting wall 17 is located forward of the plate-like body 11. Only the rear part of the supporting wall 17 (first wall 18) projects farther rearward than the body 11. Both left and right edges of the supporting wall 17 (first wall portion 18) are connected directly to the plate-like body 11 in small parts corresponding to a plate thickness of the body 11. Thus, the supporting wall 17 may be deformed to incline in the vertical direction with respect to the plate-like body 11.

As a countermeasure against such inclination, the frame 10 is formed integrally with left and right reinforcing walls 23. The reinforcing walls 23 are cantilevered forward from the front surface of the body 11. The reinforcing walls 23 extend straight along the vertical long sides 13L of the mounting portion 13. The reinforcing walls 23 are continuous substantially over the entire lengths of the long sides 13L. Left and right edges of the first wall 18 and those of the second wall 19 are connected to the inner side surfaces of the two reinforcing walls 23 facing each other.

In a front view, the supporting wall portion 17 and the left and right reinforcing walls 23 are connected to form an "H shape". Thus, the supporting wall 17 is reinforced so as not to incline in the vertical direction with respect to the plate-like body 11 or improperly deformed to curve in a side view.

Rib-like reinforcing portions 24 are formed in the front-rear direction on the outer side surfaces (side surfaces opposite to the inner side surfaces facing the mounting portion 13) of the reinforcing walls 23 to enhance the rigidity (strength) of the reinforcing walls 23. The reinforcing walls 23 reliably prevent improper deformation of the supporting wall 17.

Figure 7:
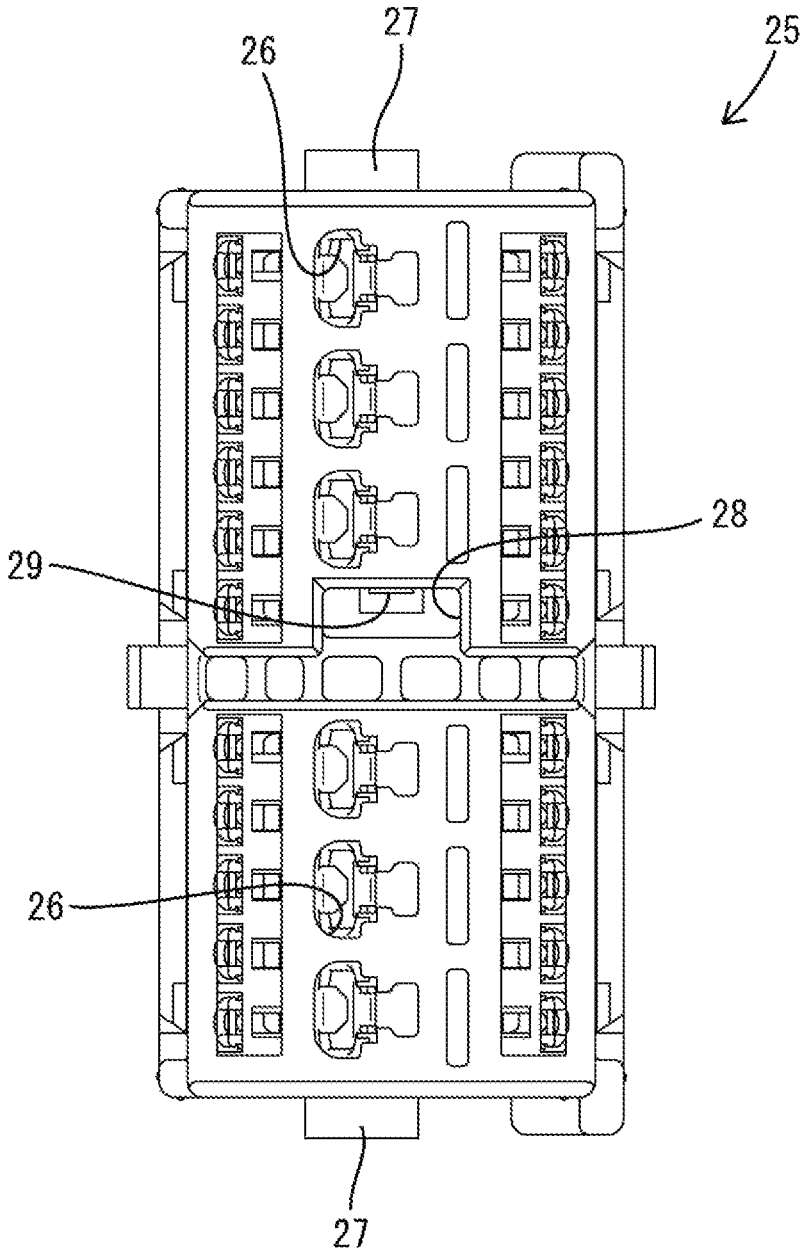
FIG. 7 is a front view of a male sub-connector.

As shown in FIG. 7, the sub-connector 25 is in the form of a block, and terminal accommodation chambers 26 are formed in the sub-connector 25. First locks 27 are formed on upper and lower outer surfaces of the sub-connector 25 and are individually lockable to the upper and lower locks 15. A groove 28 is formed in a substantially vertically central part of the front surface of the sub-connector 25 and extends in the lateral direction. A second locking 29 projects on an upper surface of the groove 28. The terminal accommodation chambers 26 are arranged separately in an area above the groove 28 (second locking portion 29) and an area below the groove 28 (second locking portion 29).

Figure 8:
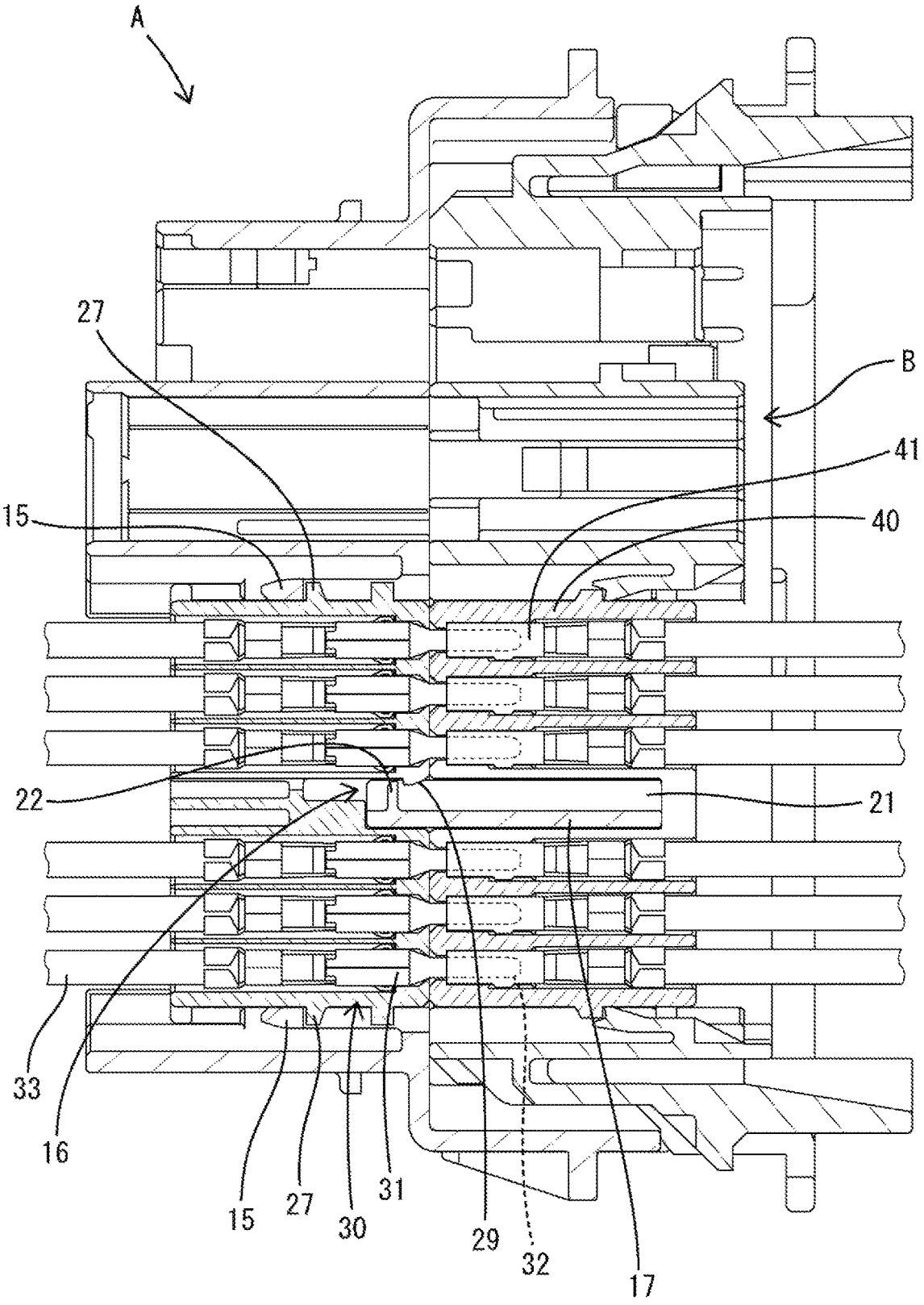
FIG. 8 is a section along X-X showing a connected state of the male split connector and a female split connector.

As shown in FIG. 8, a terminal fitting 30 is a male terminal including a terminal body 31 and a tab 32 cantilevered forward from the terminal body 31. The terminal fitting 30 is mounted into the sub-connector 25 while being inserted into the terminal accommodation chamber 26. With the terminal fitting 30 mounted in the sub-connector 25, the tab 32 projects forward from the front surface of the sub-connector 25. A front part of a wire 33 is fixed conductively to a rear part of the terminal fitting 30. The terminal fittings 30 mounted in the terminal accommodation chambers 26 are disposed between the upper and lower first locks 27 in a front view.

The sub-connector 25 is assembled by being inserted into the mounting portion 13 from behind the frame 10. Thus, the sub-connector 25 is accommodated between the two reinforcing walls 23 and the resilient lock pieces 14 interfere with the first locks 27 to deform resiliently.

When the sub-connector 25 is mounted properly into the mounting portion 13, the resilient lock pieces 14 resiliently return and the upper and lower first locks 27 individually contact the upper and lower lock portions 15 from the front or proximately face the front surfaces of the lock portions 15. Similarly, when the sub-connector 25 is mounted properly into the mounting portion 13, a rear edge of the supporting wall 17 and the receiving portion 22 enter the groove 28 and the second lock 29 contacts the receiving portion 22 or proximately faces the front surface of the receiving portion 22.

As shown in FIG. 8, the mating connector B includes a terminal accommodating portion 40 and female mating terminals 41 accommodated in the terminal accommodating portion 40. A resilient locking piece (not shown) is provided in the mating terminal 41. In the process of connecting the split connector A and the mating connector B, the tabs 32 are inserted into the mating terminals 41 and resiliently contact the resilient locking pieces. Thus, frictional resistance is created to act against a connecting operation of the terminal fittings 30 and the mating terminals 41.

This frictional resistance causes the mating connector B to press the sub-connector 25 rearward. A facing direction of the first locks 27 facing the upper and lower lock portions 15 is the same as the connecting direction of the split connector A to the mating connector B. Accordingly, even if the rearward pressing force acts on the sub-connector 25 from the mating connector B due to the frictional resistance between the terminal fittings 30 and the mating terminal 41, the locking action of the first locks 27 with the upper and lower lock portions 15 restricts the rearward separation of the sub-connector 25 from the frame 10.

The upper and lower lock portions 15 (upper and lower first locks 27) are located on both upper and lower ends of the sub-connector 25, and the terminal fittings 30 are disposed between the upper and lower lock portions 15 in a front view parallel to the connecting direction of the split connector A and the mating connector B. Thus, the sub-connector 25 may be curve and deform improperly to bulge rearward between the lock portions 15 due to the frictional resistance between the terminal fittings 30 and the mating terminals 41. However, the receiving portion 22 is arranged between the upper and lower lock portions 15, and the second lock 29 of the sub-connector 25 locks this receiving portion 22 from the front and prevents the sub-connector 25 from being curved and deformed improperly.

The split connector A can prevent the sub-connectors 25 from being deformed improperly, and is provided with the frame 10 fittable to the mating connector B and the sub-connectors 25 to be mounted into the frame 10. The mounting portions 13 penetrate through the frame 10 in the connecting direction to the mating connector B. The lock portions 15 (resilient lock pieces 14) are formed on the upper and lower sides (short sides 13S) of the mounting portion 13 facing each other. The supporting 16 is arranged between the upper and lower lock portions 15 in the opening area of the mounting portion 13.

The sub-connector 25 is mounted into the mounting portion 13 while holding the terminal fittings 30. The sub-connector 25 is formed with the first locks 27 for holding the sub-connector 25 in the mounting portion 13 by being locked to the lock portions 15. Similarly, the sub-connector 25 is formed with the second lock 29 lockable to the support 16 in a direction (rearward direction) opposite to the connecting direction (forward direction) to the mating connector B.

In connecting the frame 10 to the mating connector B, connection resistance acts from the mating connector B to the sub-connector 25 in the direction opposite to the connecting direction. Thus, the sub-connector 25 may be deformed improperly to curve between the lock portions 15. However, an area of the sub-connector 25 between the lock portions 15 is supported by the support 16 via the second lock 29 and prevents the sub-connector 25 from being curved and deformed improperly.

The support 16 includes the supporting wall 17. The supporting wall 17 couples the opening edges of the mounting portion 13, and the wall thickness direction thereof is oriented in the vertical direction intersecting the connecting direction to the mating connector B. The supporting wall 17 enhances the rigidity of the support 16 and reliably supports the sub-connector 25.

The frame 10 is formed with the reinforcing walls 23 connected to the supporting wall 17 in an intersecting manner, thereby enhancing the rigidity of the supporting wall 17. Furthermore, the supporting wall 17 is formed with the left and right ribs 21 extending in the front-rear direction along the connecting direction to the mating connector B thereby further enhancing the rigidity of the supporting wall 17. This enhanced strength and rigidity of the supporting wall 17 prevents the supporting wall 17 from being deformed to incline or curve in the wall thickness direction.

Further, the supporting 16 is provided with the receiving portion 22 projecting from the supporting wall 17 and lockable by the second lock 29. The receiving portion 22 is connected to the ribs 21 to enhance the rigidity of the receiving portion 22. In this way, the receiving portion 22 and the second lock 29 can be reliably locked and, consequently, the sub-connector 25 reliably is prevented from being improperly curved and deformed.

The invention is not limited to the above described and illustrated embodiment. For example, the following embodiments also are included in the scope of the invention.

Although the support includes the supporting wall in the above embodiment, the support may be in the form of an elongated beam as a whole.

Although the reinforcing walls are disposed along the opening edges of the mounting portion in the above embodiment, the reinforcing walls may be disposed at positions different from the opening edges of the mounting portion.

Although the reinforcing walls are formed to enhance the rigidity of the supporting wall portion in the above embodiment, the frame may have no reinforcing wall.

Although the supporting wall is formed with the ribs in the above embodiment, the supporting wall may have no rib.

Although the receiving portion is formed to be connected to the ribs in the above embodiment, the receiving portion may not be connected to the ribs.

Although the receiving portion projects from the supporting wall in the above embodiment, the receiving portion may be formed by recessing the supporting wall or cutting the supporting wall.

LIST OF REFERENCE SIGNS

A . . . split connector
B . . . mating connector
10 . . . frame
13 . . . mounting portion
15 . . . lock portion
16 . . . support
17 . . . supporting wall
21 . . . rib
22 . . . receiving portion
23 . . . reinforcing wall
25 . . . sub-connector
27 . . . first lock
29 . . . second lock
30 . . . terminal fitting

What is claimed is:

1. A split connector, comprising:

a frame fittable to a mating connector;

a mounting portion penetrating through the frame in a connecting direction to the mating connector;

lock portions formed on two opposed opening edge parts of the mounting portion;

a support disposed between the lock portions in an opening area of the mounting portion;

a sub-connector to be mounted into the mounting portion while holding a terminal fitting;

two first locks formed on the sub-connector, the first locks holding the sub-connector in the mounting portion by being locked to the pair of lock portions; and a second lock formed on the sub-connector and lockable to the support in a direction opposite to the connecting direction to the mating connector.

2. The split connector of claim 1, wherein the support couples the opening edges of the mounting portion and includes a supporting wall, a wall thickness direction of the supporting wall being oriented in a direction intersecting the connecting direction to the mating connector.

3. The split connector of claim 2, further comprising a reinforcing wall formed on the frame and connected to the supporting wall in an intersecting manner.

4. The split connector of claim 3, further comprising a rib formed on the supporting wall and extending in a direction along the connecting direction to the mating connector.

5. The split connector of claim 4, wherein:

the support is provided with a receiving portion projecting from the supporting wall and lockable by the second lock; and the receiving portion is connected to the rib.

6. The split connector of claim 2, further comprising a rib formed on the supporting wall and extending in a direction along the connecting direction to the mating connector.

7. The split connectorof claim 6, wherein:

the support is provided with a receiving portion projecting from the supporting wall and lockable by the second lock; and the receiving portion is connected to the rib.

* * * * *